US009715861B2

(12) United States Patent
Kim et al.

(10) Patent No.: US 9,715,861 B2
(45) Date of Patent: Jul. 25, 2017

(54) DISPLAY DEVICE HAVING UNIT PIXEL DEFINED BY EVEN NUMBER OF ADJACENT SUB-PIXELS

(71) Applicant: Samsung Display Co., Ltd., Yongin, Gyeonggi-Do (KR)

(72) Inventors: Jinpil Kim, Suwon-si (KR); Jai-Hyun Koh, Hwaseong-si (KR); Namjae Lim, Seoul (KR); Ik Soo Lee, Seoul (KR); Heendol Kim, Yongin-si (KR); Se Ah Kwon, Seoul (KR); Kisoo Park, Seoul (KR); Jonghak Hwang, Yongin-si (KR)

(73) Assignee: SAMSUNG DISPLAY CO., LTD, Gyeonggi-Do (KR)

( * ) Notice: Subject to any disclaimer, the term of this patent is extended or adjusted under 35 U.S.C. 154(b) by 104 days.

(21) Appl. No.: 13/934,424

(22) Filed: Jul. 3, 2013

(65) Prior Publication Data

US 2014/0232624 A1 Aug. 21, 2014

(30) Foreign Application Priority Data

Feb. 18, 2013 (KR) ..... 10-2013-0017148

(51) Int. Cl.
*G09G 3/36* (2006.01)

(52) U.S. Cl.
CPC ..... *G09G 3/3696* (2013.01); *G09G 3/3607* (2013.01); *G09G 3/3614* (2013.01)

(58) Field of Classification Search
CPC ... G09G 3/3696; G09G 3/3607; G09G 3/3614
USPC ..... 345/96, 690
See application file for complete search history.

(56) References Cited

U.S. PATENT DOCUMENTS

| | | | |
|---|---|---|---|
| 6,525,708 | B2 | 2/2003 | Lin et al. |
| 6,734,840 | B2 | 5/2004 | Fukutoku et al. |
| 7,088,328 | B2 | 8/2006 | Inada et al. |
| 7,102,610 | B2 | 9/2006 | Ludden |
| 7,187,353 | B2 | 3/2007 | Credelle et al. |
| 7,209,105 | B2 | 4/2007 | Elliott |
| 7,218,301 | B2 | 5/2007 | Credelle |

(Continued)

FOREIGN PATENT DOCUMENTS

| | | | |
|---|---|---|---|
| CN | 1949357 | A | 4/2007 |
| CN | 102568417 | A | 7/2012 |

(Continued)

*Primary Examiner* — Chanh Nguyen
*Assistant Examiner* — Daniel Duong
(74) *Attorney, Agent, or Firm* — Cantor Colburn LLP

(57) ABSTRACT

A display device includes a display panel including gate lines which extends in a first direction, data lines which extends in a second direction, and sub-pixels connected to corresponding gate and data lines, a gate driver configured to drive the gate lines, a data driver configured to apply a gray-scale voltage to the data lines, and a timing controller configured to generate and apply control signals to the gate and data drivers, where a unit pixel of the display panel is defined by an even number of adjacent sub-pixels among the sub-pixels, each of the data lines is connected to corresponding sub-pixels of the sub-pixels, the data driver inverts a polarity of the gray-scale voltage every two data lines, and two adjacent sub-pixels in the unit pixel are applied with the gray-scale voltages having different polarities.

14 Claims, 17 Drawing Sheets

(56) References Cited

U.S. PATENT DOCUMENTS

| | | | | |
|---|---|---|---|---|
| 7,573,448 | B2 | 8/2009 | Credelle et al. | |
| 7,920,114 | B2 | 4/2011 | Shiomi | |
| 8,035,610 | B2 | 10/2011 | Hsu | |
| 8,264,656 | B2 | 9/2012 | Lee et al. | |
| 8,723,899 | B2 | 5/2014 | Kim et al. | |
| 9,275,568 | B2 | 3/2016 | Peng et al. | |
| 2007/0091044 | A1* | 4/2007 | Park | G09G 3/3648 345/88 |
| 2008/0180378 | A1* | 7/2008 | Tang | 345/96 |
| 2009/0040243 | A1* | 2/2009 | Hisada et al. | 345/690 |
| 2010/0097366 | A1 | 4/2010 | Kitayama et al. | |
| 2010/0328360 | A1* | 12/2010 | Miyashita | 345/690 |
| 2011/0249046 | A1 | 10/2011 | Lee et al. | |
| 2011/0273494 | A1 | 11/2011 | Jun | |
| 2012/0162172 | A1 | 6/2012 | Lee et al. | |
| 2012/0176351 | A1 | 7/2012 | Hsieh et al. | |

FOREIGN PATENT DOCUMENTS

| | | | |
|---|---|---|---|
| JP | 2001174783 | A | 6/2001 |
| JP | 2002072981 | A | 3/2002 |
| JP | 2003215540 | A | 7/2003 |
| JP | 2004279626 | A | 10/2004 |
| JP | 2004341134 | A | 12/2004 |
| JP | 2008233415 | A | 10/2008 |
| JP | 2009042378 | A | 2/2009 |
| JP | 2010204657 | A | 9/2010 |
| JP | 2011008190 | A | 1/2011 |
| JP | 2011248329 | A | 12/2011 |
| KR | 1020030050895 | A | 6/2003 |
| KR | 1020030086048 | A | 11/2003 |
| KR | 1020080089747 | A | 10/2008 |
| KR | 1020080108739 | A | 12/2008 |
| KR | 1020080109989 | A | 12/2008 |
| KR | 1020090065110 | A | 6/2009 |
| KR | 1020110043889 | A | 4/2011 |
| KR | 1020110067227 | A | 6/2011 |
| KR | 1020110107659 | A | 10/2011 |
| KR | 1020120073793 | A | 7/2012 |
| WO | 2006070559 | A1 | 7/2006 |

* cited by examiner

DISPLAY DEVICE HAVING UNIT PIXEL DEFINED BY EVEN NUMBER OF ADJACENT SUB-PIXELS

DISPLAY DEVICE

This application claims priority to Korean Patent Application No. 10-2013-0017 148, filed on Feb. 18, 2013, and all the benefits accruing therefrom under 35 U.S.C. §119, the content of which in its entirety is herein incorporated by reference.

BACKGROUND

1. Field

The disclosure relates to a display device.

2. Description of the Related Art

In general, a display device includes a display panel to display an image, and data and gate drivers to drive the display panel. The display panel typically includes gate lines, data lines and sub-pixels. Each sub-pixel typically includes a thin film transistor, a liquid crystal capacitor and a storage capacitor. The data driver may apply gray-scale voltages to the data lines and the gate driver applies gate signals to the gate lines.

In the display device, a gate-on voltage is applied to the gate line connected to a gate electrode of the thin film transistor, and a data voltage corresponding to an image to be displayed is applied to a source electrode of the thin film transistor. When the thin film transistor is turned on by the gate-on voltage, the data voltage applied to the liquid crystal capacitor and the storage capacitor is maintained for a predetermined time after the thin film transistor is turned off.

When an electric field is repeatedly applied to the liquid crystal capacitor of the sub-pixel in only one direction, a liquid crystal layer may be degraded in electrical and physical properties. Accordingly, the application direction of the electric field may be periodically changed. To change the direction of the electric field, an inversion driving method that inverts a polarity of a voltage applied to one electrode with respect to the other one electrode is widely used, such that a polarity of the gray-scale voltage applied to the sub-pixel is inverted every frame.

The display device typically displays a color using three primary colors. Therefore, the display panel includes the sub-pixels respectively corresponding to red, blue, green colors. In recent years, the display device that further includes a white sub-pixel has been suggested to enhance the brightness of the image. In the display device including the white sub-pixel, red, blue and green image signals provided applied to the display panel from an external source may be used to be converted to red, blue, green and white data signals.

SUMMARY

The disclosure provides a display device having improved image display quality.

According to an exemplary embodiment of the invention, a display device includes a display panel including a plurality of gate lines which extends in a first direct ion, a plurality of data lines which extends in a second direction different from the first direction, and a plurality of sub-pixels, each of which is connected to a corresponding gate line of the gate lines and a corresponding data line of the data lines, a gate driver configured to drive the gate lines, a data driver configured to apply a gray-scale voltage to the data lines, and a timing controller configured to generate a plurality of control signals and to apply the control signals to the gate driver and the data driver. In such an embodiment, a unit pixel of the display panel is defined by an even number of adjacent sub-pixels among the sub-pixels, each of the data lines is connected to corresponding sub-pixels of the sub-pixels, the data driver inverts a polarity of the gray-scale voltage every two data lines, and two adjacent sub-pixels in the unit pixel are applied with the gray-scale voltages having different polarities.

In an example embodiment, the even number of adjacent sub-pixels may include a red sub-pixel, a green sub-pixel, a blue sub-pixel and a white sub-pixel, the unit pixel may include a first type pixel and a second type pixel, and each of the first and second type pixels may include two sub-pixels among the red sub-pixel, the green sub-pixel, the blue sub-pixel and the white sub-pixel of the even number of adjacent sub-pixels.

In an example embodiment, the first type pixel may include the red sub-pixel and the green sub-pixel, and the second type pixel may include the blue sub-pixel and the white sub-pixel.

In an example embodiment, the first type pixel and the second type pixel may be arranged adjacent to each other in the first and second directions.

In an example embodiment, the each of the data lines may be connected to a left side of the corresponding sub-pixels among the sub-pixels.

In an example embodiment, the data driver may invert the polarity of the gray-scale voltage applied to the each of the data lines every frame.

In an example embodiment, a first data line of the data lines may be connected to red and blue sub-pixels alternately arranged with each other in the second direction, a second data line of the data lines may be connected to green and white sub-pixels alternately arranged with each other in the second direction, a third data line of the data lines may be connected to blue and red sub-pixels alternately arranged with each other in the second direction, a fourth data line of the data lines may be connected to white and green sub-pixels alternately arranged with each other in the second direction, and the first, second, third and fourth data lines may be sequentially arranged in the first direction.

In an example embodiment, the timing controller may apply a data signal to the data driver in response to an image signal from an outside thereof and may activate an inversion mode signal when the image signal has a predetermined image pattern.

In an example embodiment, the data driver may receive the data signal and the inversion mode signal, and set the polarity of the gray-scale voltage applied to the data lines in response to the inversion mode signal.

In an example embodiment, the data driver may invert the polarity of the gray-scale voltage every two data lines when the inversion mode signal is inactivated, and set the polarities of the gray-scale voltages applied to the two adjacent sub-pixels in the unit pixel to be different from each other.

In an example embodiment, the data driver may invert the polarity of the gray-scale voltage every data line when the inversion mode signal is activated.

In an example embodiment, the data driver may invert the polarity of the gray-scale voltage applied to the each of the data lines every frame.

In an example embodiment, the timing controller may include a pentile converter configured to convert the image signal to the data signal corresponding to the red, green, blue and white sub-pixels, and an inversion mode selector configured to activate the inversion mode signal when the image signal has the predetermined image pattern.

In an example embodiment, the predetermined image pattern may include an image pattern displayed by turning on the green and blue sub-pixels and turning off the red and white sub-pixels.

In an example embodiment, when the image signal has the predetermined image pattern in a frame, the timing controller may activate the inversion mode signal at a starting point of a next frame.

According to one or more exemplary embodiments, the unit pixel includes the even number of adjacent sub-pixels, the polarity of the gray-scale voltage is inverted every two data lines, and the polarities of the gray-scale voltages applied to two adjacent sub-pixels in the unit pixel are different from each other. In such embodiments, the display quality of the image displayed on the display panel is effectively prevented from being degraded and power consumption of the display device is substantially reduced. In such embodiments, the inversion mode is changed when a predetermined pattern is input, and thus the crosstalk is effectively prevented.

BRIEF DESCRIPTION OF THE DRAWINGS

The above and other features of the invention will become readily apparent by reference to the following detailed description when considered in conjunction with the accompanying drawings, in which.

DETAILED DESCRIPTION

Figure 1:
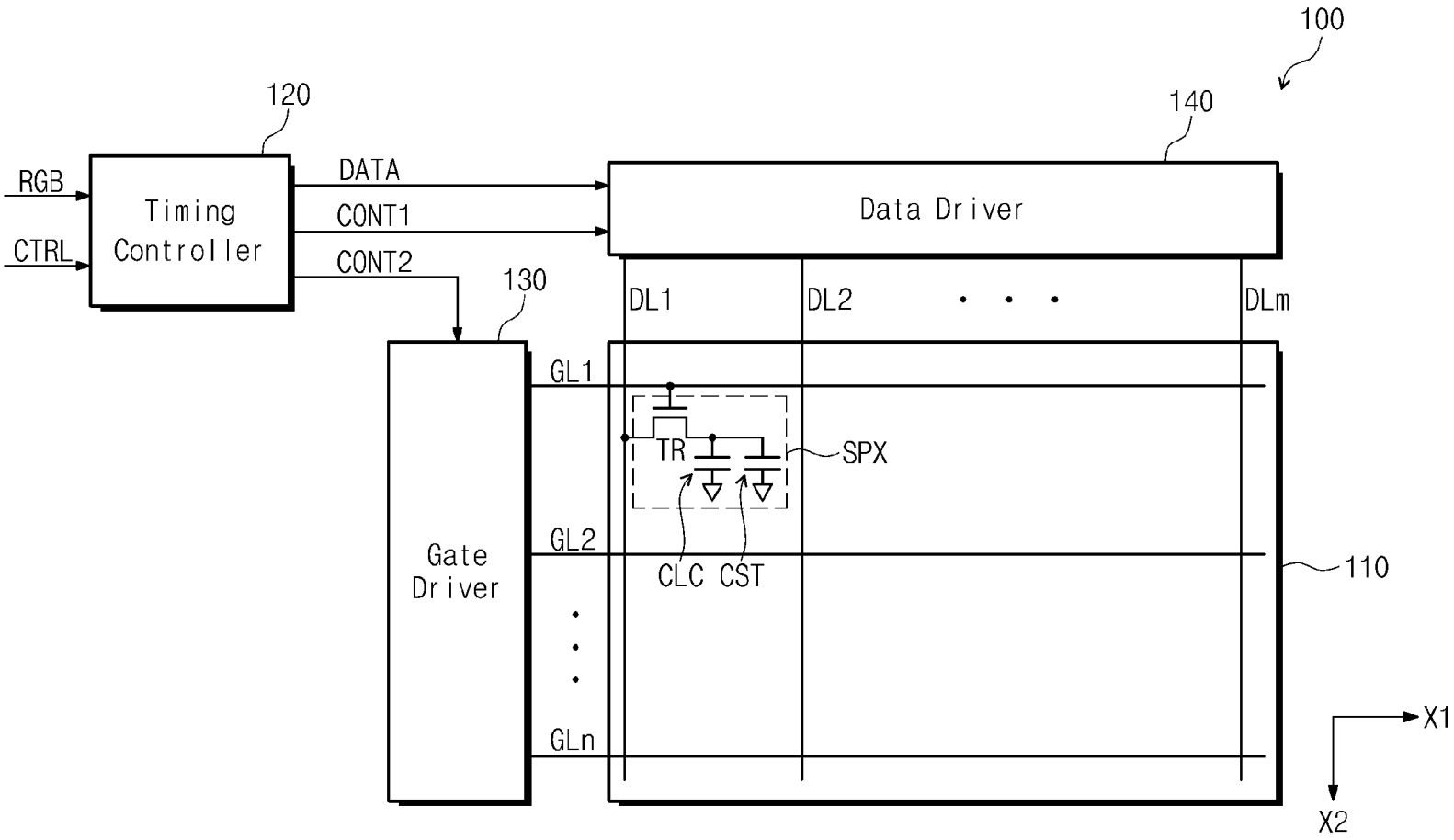
FIG. 1 is a block diagram showing an exemplary embodiment of a display device according to the invention.

The invention will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teaching of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated here in but are to include deviations in shapes that result, for example, from manufacturing. For example, a region illustrated or described as flat may, typically, have rough and/or nonlinear features. Moreover, sharp angles that are illustrated may be rounded.

Thus, the regions illustrated in the figures are schematic in nature and their shapes are not intended to illustrate the precise shape of a region and are not intended to limit the scope of the claims set forth herein.

All methods described herein can be performed in a suitable order unless other wise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

FIG. 1 is a block diagram showing an exemplary embodiment of a display device according to the invention.

Referring to FIG. 1, an exemplary embodiment of a display device 100 include a display panel 110, a timing controller 120, a gate driver 130 and a data driver 140.

The display panel 110 includes a plurality of data lines DL1 to DLm that extends in a first direction X1, a plurality of gate lines GL1 to GLn that extends in a second direction X2 crossing the data lines DL1 to DLm, and a plurality of sub-pixels SPX connected to the data lines DL1 to DLm and the gate lines GL1 to GLn. In an exemplary embodiment, the sub-pixels SPX may be arranged on the display panel 110 substantially in a matrix form. In such an embodiment, each of "n" and "m" is a natural number greater than zero (0). The data lines DL1 to DLm are insulated from the gate lines GL1 to GLn.

Each sub-pixel SPX includes a switching transistor TR connected to a corresponding data line of the data lines DL1 to DLm and a corresponding gate line of the gate line GL1 to GLn, a liquid crystal capacitor CLC connected to the switching transistor TR, a storage capacitor CST connected to the switching transistor TR.

The sub-pixels SPX have substantially the same structure as each other. There fore, hereinafter one sub-pixel will be described in detail, for convenience of description. The switching transistor TR of a sub-pixel SPX includes a gate electrode connected to a first gate line GL1 of the gate lines GL1 to GLn, a source electrode connected to a first data line DL1 of the data lines DL1 to DLm, and a drain electrode connected to the liquid crystal capacitor CLC and the storage capacitor CST. Terminals of the liquid crystal capacitor CLC and the storage capacitor CST are connected to the drain electrode of the switching transistor TR in parallel, and the other terminals of the liquid crystal capacitor CLC and the storage capacitor CST are connected to a common voltage. In an exemplary embodiment, the switching transistor TR may be a thin film transistor, but not being limited thereto.

The timing controller 120 receives image signals RGB and control signals CTRL, e.g., a vertical synchronization signal, a horizontal synchronization signal, a main clock signal, a data enable signal, etc., to control the image signals RGB. The timing controller 120 converts the image signal RGB to data signal DATA corresponding to an operation condition of the display panel 110 based on the control signals CTRL. The timing controller 120 applies the data signal DATA and a first control signal CONT1 to the data driver 140, and applies a second control signal CONT2 to the gate driver 130. The first control signal CONT1 includes a horizontal synchronization start signal, a clock signal and a line latch signal, and the second control signal CONT2 includes a vertical synchronization start signal, an output enable signal and a gate pulse signal.

The data driver 140 outputs data driving signals to drive the data lines DL1 to DLm in response to the data signal DATA and the first control signal CONT1 from the timing controller 120.

The gate driver 130 outputs a gate-on voltage VON and a gate-off voltage VOFF (shown in FIG. 4) to drive the gate lines GL1 to GLn in response to the second control signal CONT2 from the timing controller 120. In an exemplary embodiment, the gate driver 130 includes a gate driver integrated circuit ("IC"), but not being limited thereto.

In an exemplary embodiment, the gate driver 130 may be configured to include a circuit including oxide semiconductor, amorphous semiconductor, crystalline semiconductor or polycrystalline semiconductor.

When the gate-on voltage VON is applied to one gate line, switching transistors of the sub-pixels arranged in a corresponding row and connected to the one gate line are turned on. When the switching transistors are turned on, the data driver 140 provides the data driving signals corresponding to the data signal DATA to the data lines DL1 to DLm. The data driving signals applied to the data lines DL1 to DLm are applied to corresponding sub-pixels through the turned-on switching transistors. Here, a period in which the switching transistors corresponding to one row are turned on, e.g., one period of the output enable signal, is referred to as "one horizontal period" or "1H".

Figure 2:
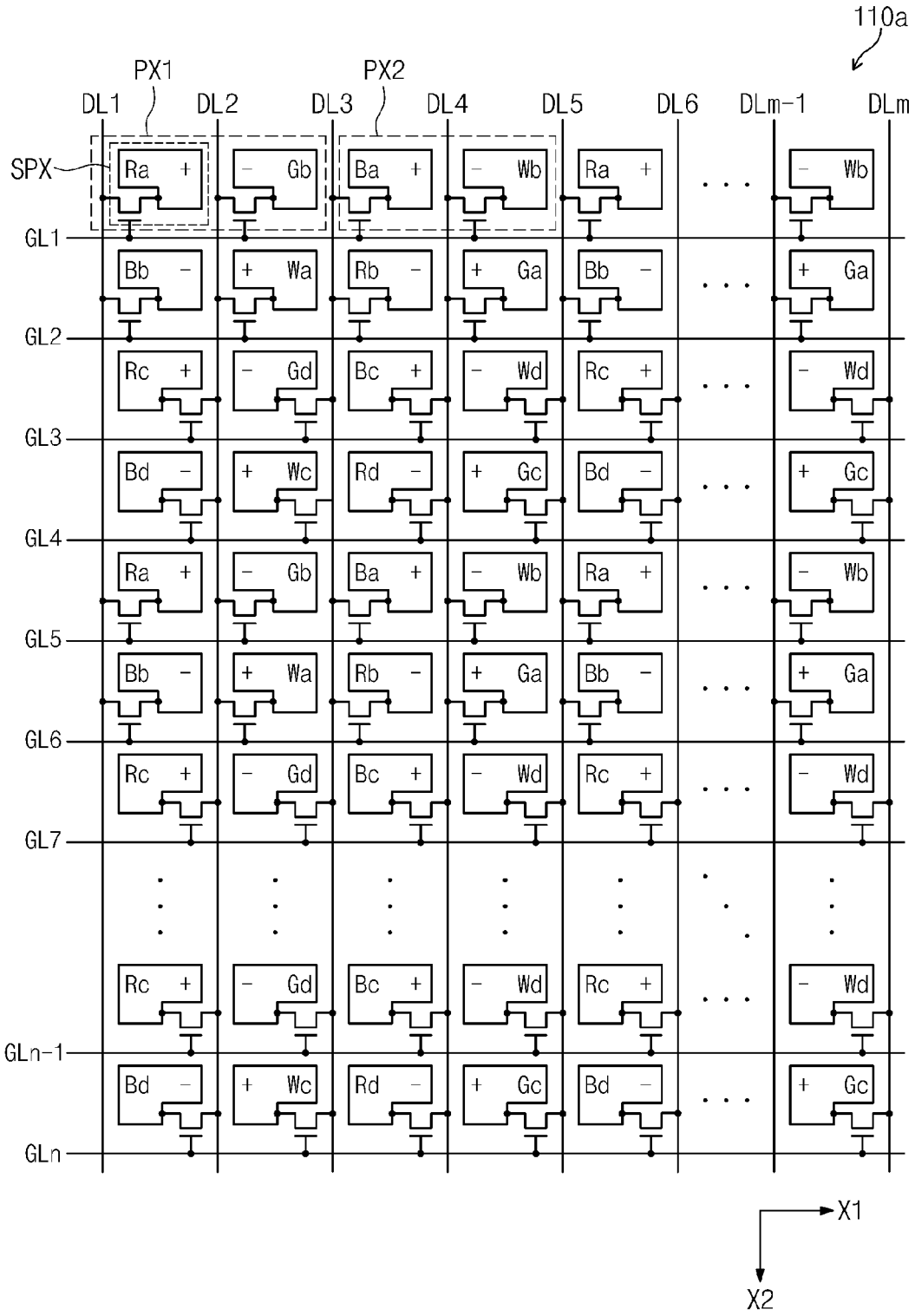
FIG. 2 is a view showing an exemplary embodiment of an arrangement of pixels in a display panel shown in FIG. 1 according to an exemplary embodiment of the invention.

FIG. 2 is a view showing an arrangement of an exemplary embodiment of pixels in a display panel shown in FIG. 1 according to the invention.

Referring to FIG. 2, a display panel 110*a* includes a plurality of unit pixels in eluding a first type pixel PX1 and a second type pixel PX2. Each of first and second type pixels PX1 and PX2 includes an even number of sub-pixels. In an exemplary embodiment, as shown in FIG. 2, each of first and second type pixels PX1 and PX2 includes two sub-pixels. In one exemplary embodiment, for example, the first type pixel PX1 includes a red sub-pixel and a green sub-pixel, and the second type sub-pixel PX2 includes a blue sub-pixel and a white sub-pixel.

As described with reference to FIG. 1, each sub-pixel SPX includes the switching transistor TR, the liquid crystal capacitor CLC and the storage capacitor CST (not shown in FIG. 2). As described above, the switching transistor is connected to the corresponding data line and the corresponding gate line. In an exemplary embodiment, as shown in FIG. 2, the first type pixels PX1 and the second type pixels PX2 are sequentially arranged in the first direction X1, in which the gate lines GL1 to GLn extend. In such an embodiment, the first type pixels PX1 and the second type pixels PX2 are sequentially arranged in the second direction X2 in which the data lines DL1 to DLm extend.

In an exemplary embodiment, the red, green, blue and white sub-pixels are alternately connected to a left-side data line and a right-side data line every two rows, e.g., in a zigzag connection structure. In such an embodiment, the sub-pixels connected to g-th and (g+1)-th gate lines GLg and GLg+1 (here, g is a positive integer) may be connected to the left-side data line, and the sub-pixels connected to (g+2)-th and (g+3)-th gate lines GLg+2 and GLg+3 may be connected to the right-side data line.

In FIG. 2, FIG. 3, FIG. 5, FIG. 6, FIG. 7, FIG. 8, FIG. 10, FIG. 12 and FIG. 16, the red-sub pixel, the green sub-pixel, the blue-sub pixel and the white sub-pixel are referred to as R, G, B and W, respectively. In the figures, among the red, green, blue, and white sub-pixels, the sub-pixels connected to the left-side data line and operated in a positive (+) polarity in an i-th frame (i is a positive integer) are referred to as Ra, Ga, Ba and Wa, respectively, and the sub-pixels connected to the left-side data line and operated in a negative (−) polarity in the i-th frame are referred to as Rb, Gb, Bb and Wb, respectively. In the figures, among the red, green, blue and white sub-pixels, the sub-pixels connected to the right-side data line and operated in a positive (+) polarity in the i-th frame are referred to as Rc, Gc, Bc and Wc, respectively, and the sub-pixels connected to the right-side data line and operated in the negative (−) polarity in the i-th frame are referred to as Rd, Gd, Bd and Wd, respectively.

In an exemplary embodiment, the red-sub pixels of the first type pixel PX1, which are connected to the left-side data line and operated in the positive (+) polarity in the i-th frame, are referred to as "Ra", and the green-sub pixels of the first type pixel PX1, which are connected to the left-side data line and operated in the positive (+) polarity in the i-th frame, are referred to as "Ga".

In an exemplary embodiment, as shown in FIG. 2, the sub-pixels connected to the first gate line GL1 are arranged along the first direction X1 in the order of Ra, Gb, Ba, Wb, Ra, . . . , Wb, and the sub-pixels connected to a second gate line GL2 a re arranged along the first direction X1 in the order of Bb, Wa, Rb, Ga, Bb, . . . , Ga.

In an exemplary embodiment, as shown in FIG. 2, the sub-pixels connected to the first data line DL1 are arranged along the second direction X2 in the order of Ra, Bb, Ra, Bb, . . . , Ra, and Bb, and the sub-pixels connected to a second data line DL2 are arranged along the second direction X2 in the order of Gb, Wa, Rc, Bd, Gb, Wa, . . . , Rc and Bd.

However, the arrangement of the sub-pixels of an exemplary embodiment of the display panel 110*a* is not be limited to the arrangement shown in FIG. 2.

FIG. 2 shows the polarities of the gray-scale voltages applied to the sub-pixels of the display panel 110*a* in the i-th frame, but the polarities of the gray-scale voltages applied to the sub-pixels of the display panel 110*a* are inverted in an (i+1)-th frame.

In an exemplary embodiment, as shown in FIG. 2, the sub-pixels may receive the gray-scale voltages having different polarities during one frame. In such an embodiment, the subpixels include Ra, Rb, Rc, Rd, Ga, Gb, Gc, Gd, Ba, Bb, Bc, Bd, Da, Db, Dc and Dd in one frame, and thus a flicker is substantially reduced.

Figure 3:
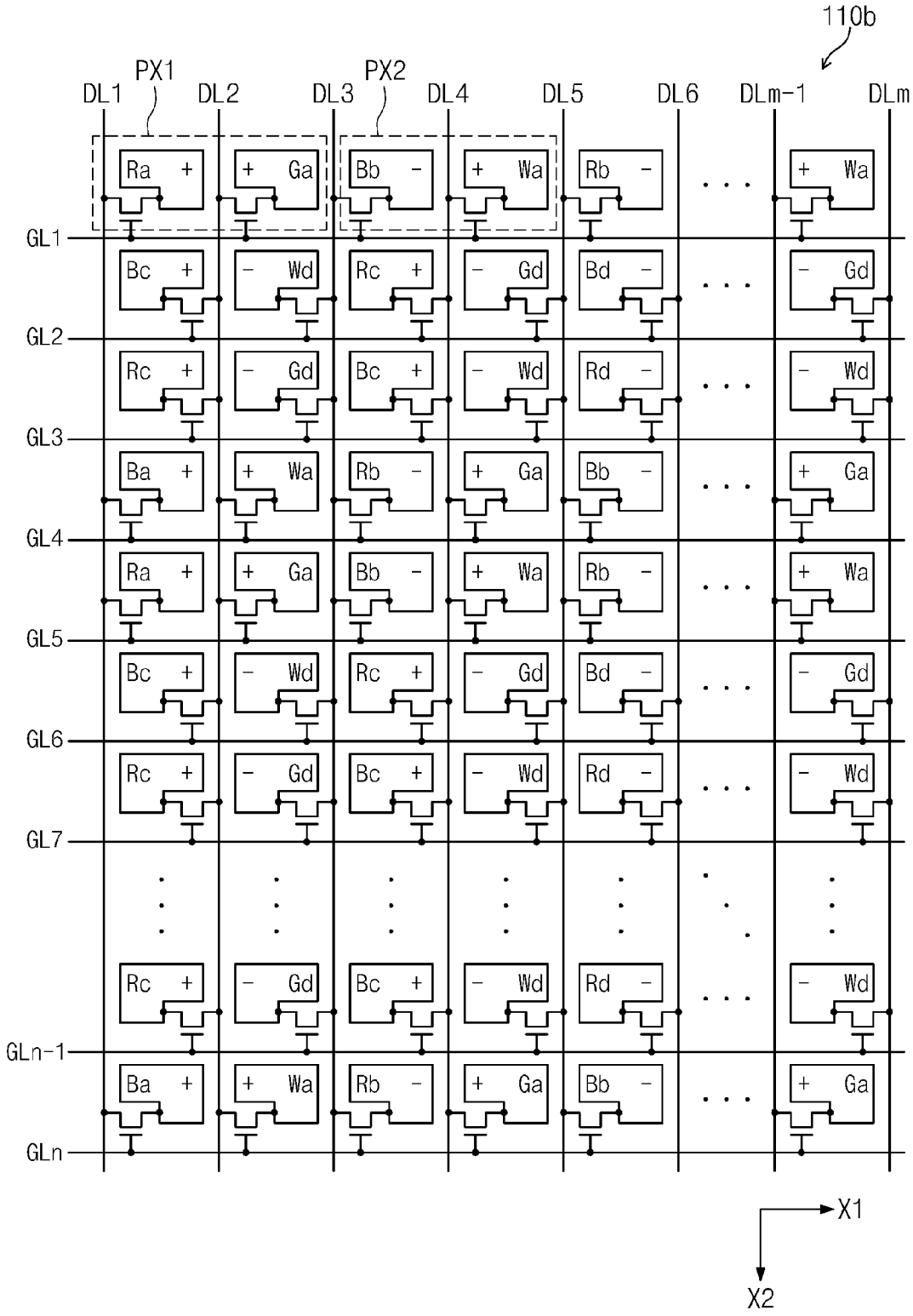
FIG. 3 is a view showing an alternative exemplary embodiment of an arrangement of pixels in a display panel shown in FIG. 1 according to the invention.

FIG. 3 is a view showing an exemplary embodiment of an arrangement of pixels in a display panel shown in FIG. 1 according to the invention.

Referring to FIG. 3, an exemplary embodiment of a display panel 110*b* include a plurality of unit pixels including a first type pixel PX1 and a second type pixel PX2 as similar to the display panel 110*a* shown in FIG. 2. Each of first and second type pixels PX1 and PX2 includes an even number of sub-pixels. In an exemplary embodiment, as shown in FIG. 3, each of first and second type pixels PX1 and PX2 includes two sub-pixels. In one exemplary embodiment, for instance, the first type pixel PX1 includes a red sub-pixel R and a green sub-pixel G, and the second type sub-pixel PX2 includes a blue sub-pixel B and a white sub-pixel W. In such an embodiment, the arrangement of the red, green, blue and white sub-pixels R, G, B and W is the same as the arrangement of the red, green, blue and white sub-pixels R, G, B and W of the display panel 110*a* shown in FIG. 2.

In such an embodiment, the connection structure between the red, green, blue, and white sub-pixels R, G, B and W and the data lines DL1 to DLm is different from the connection structure between the red, green, blue, and white sub-pixels R, G, B and W and the data lines DL1 to DLm of the display panel 110*a* shown in FIG. 2.

In an exemplary embodiment, as shown in FIG. 3, the red, green, blue and white sub-pixels R, G, B and W are alternately connected to the left-side data line and the right-side data line, e.g., in a zigzag connection structure. In such an embodiment, the sub-pixels connected to the first gate line GL1 are connected to the left-side data line. Then, the sub-pixels connected to (4g−2)-th and (4g−1)-th gate lines GL4g−2 and GL4g−1 (g is a positive integer) are connected to the right-side data line, and the sub-pixels connected to 4g-th and (4g+1)-th gate lines GL4g and GL4g+1 are connected to the left-side data line. In such an embodiment, the sub-pixels except for the sub-pixels connected to the first gate line GL1 are alternately connected to the left-side data line and the right-side data line every two rows.

The display panel 110*b* shown in FIG. 3 is driven in a column inversion manner in which polarities of the voltages applied to the data lines are alternating per column.

In an exemplary embodiment, when the data lines DL1 to DLm are driven in the column inversion manner by the data driver 140, an inversion appearing on a screen, i.e., an apparent inversion, may be substantially the same dot inversion based on the connection between the sub-pixels and the data lines. In such an embodiment, gray scale voltages applied to adjacent pixels have complementary polarities, e.g., polarities opposite to each other. In such an embodiment, where the apparent inversion is the dot inversion, a brightness difference caused by a kickback voltage is substantially reduced such that a vertical flicker is effectively prevented.

In an exemplary embodiment, where the display panel 110*a* is driven in the dot-inversion manner, as shown in FIG. 2, the polarities of the gray-scale voltages applied through the data lines are inverted every one horizontal period, and power consumption may be increased. In an exemplary embodiment, where the display panel 110*b* is driven in the column inversion manner, as shown in FIG. 3, the power consumption in the display panel 110*b* is substantially reduced.

Figure 4:
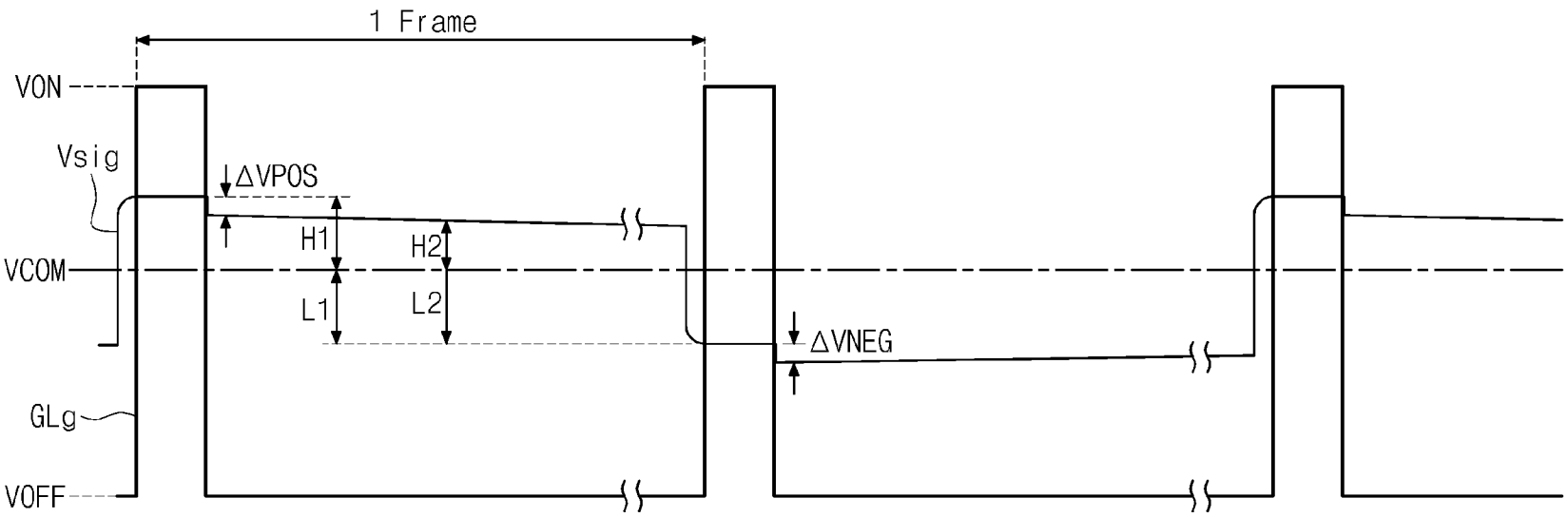
FIG. 4 is a waveform diagram showing an exemplary embodiment of a kickback voltage of a gray-scale voltage applied to each pixel of the display panel shown in FIG. 3.

FIG. 4 is a waveform diagram showing the kickback voltage of an exemplary embodiment of the gray-scale voltage applied to each pixel of the display panel shown in FIG. 3.

Referring to FIGS. 3 and 4, a signal applied to a gate line, e.g., a g-th gate line GLg, swings between the gate-on voltage VON and the gate-off voltage VOFF. The signal applied to the gate line GLg is applied to the gate electrode of the switch ing transistor in a sub-pixel, and the gray-scale voltage Vsig is applied to the source electrode of the switching transistor through a data line connected to the sub-pixel. In an exemplary embodiment, the polarity of the gray-scale voltage Vsig is inverted every frame to the negative (−) polarity from the positive (+) polarity with respect to a common voltage VCOM or vice versa. A difference H1 between the common voltage VCOM and the positive (+) gray-scale voltage Vsig provided through the data line may be equal to a difference L1 between the common voltage VCOM and the ne gative (−) gray-scale voltage Vsig (H1=L1).

However, in an exemplary embodiment, a distortion may occur in the gray-scale voltage Vsig applied to the liquid crystal capacitor and the storage capacitor due to a parasitic capacitance Cgd between the gate and drain electrodes of the switching transistor, which is formed when the display panel 110*b* is manufactured. In such an embodiment, a voltage level of the gray-scale voltage Vsig applied to the liquid crystal capacitor and the storage capacitor becomes lower than a voltage level of the gray-scale voltage output from the data driver 140. This distorted voltage is called the kickback voltage ΔV. When the kickback voltage with respect to the positive (+) gray-scale voltage Vsig and the kickback voltage with respect to the negative (−) gray-scale voltage Vsig are referred to as ΔVPOS and ΔVNEG, respectively, a difference H2 between the common voltage VCOM and the positive (+) gray-scale voltage Vsig becomes different from a difference L2 between the common voltage VCOM and the negative (−) gray-scale Vsig (H2<L2) due to the kickback voltages ΔVPOS and ΔVNEG FIGS. 5 and 6 are a view showing a portion of the display panel shown in FIG. 3.

Figure 5:
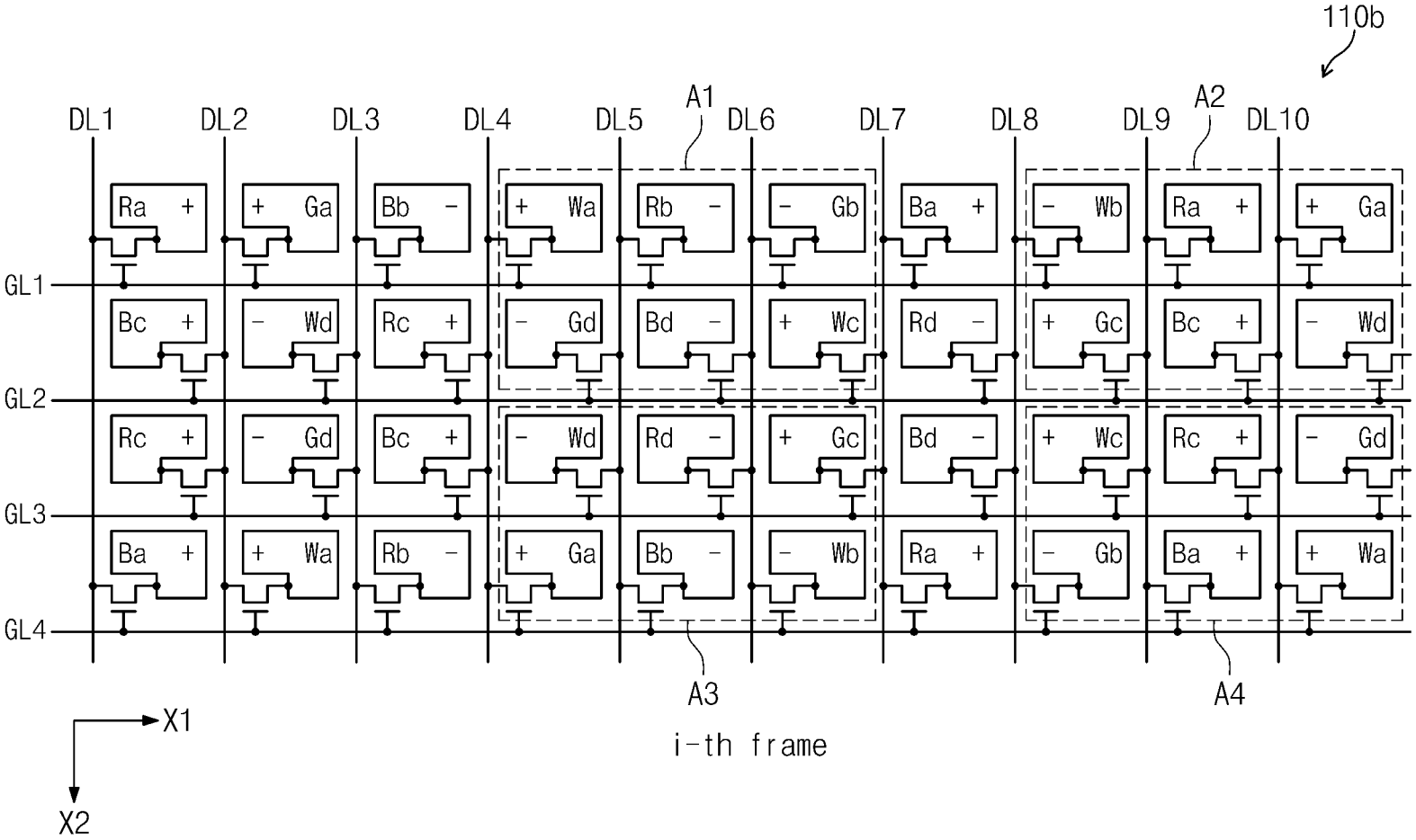
FIGS. 5 and 6 are a view showing a portion of the display panel shown in FIG. 3.
Figure 6:
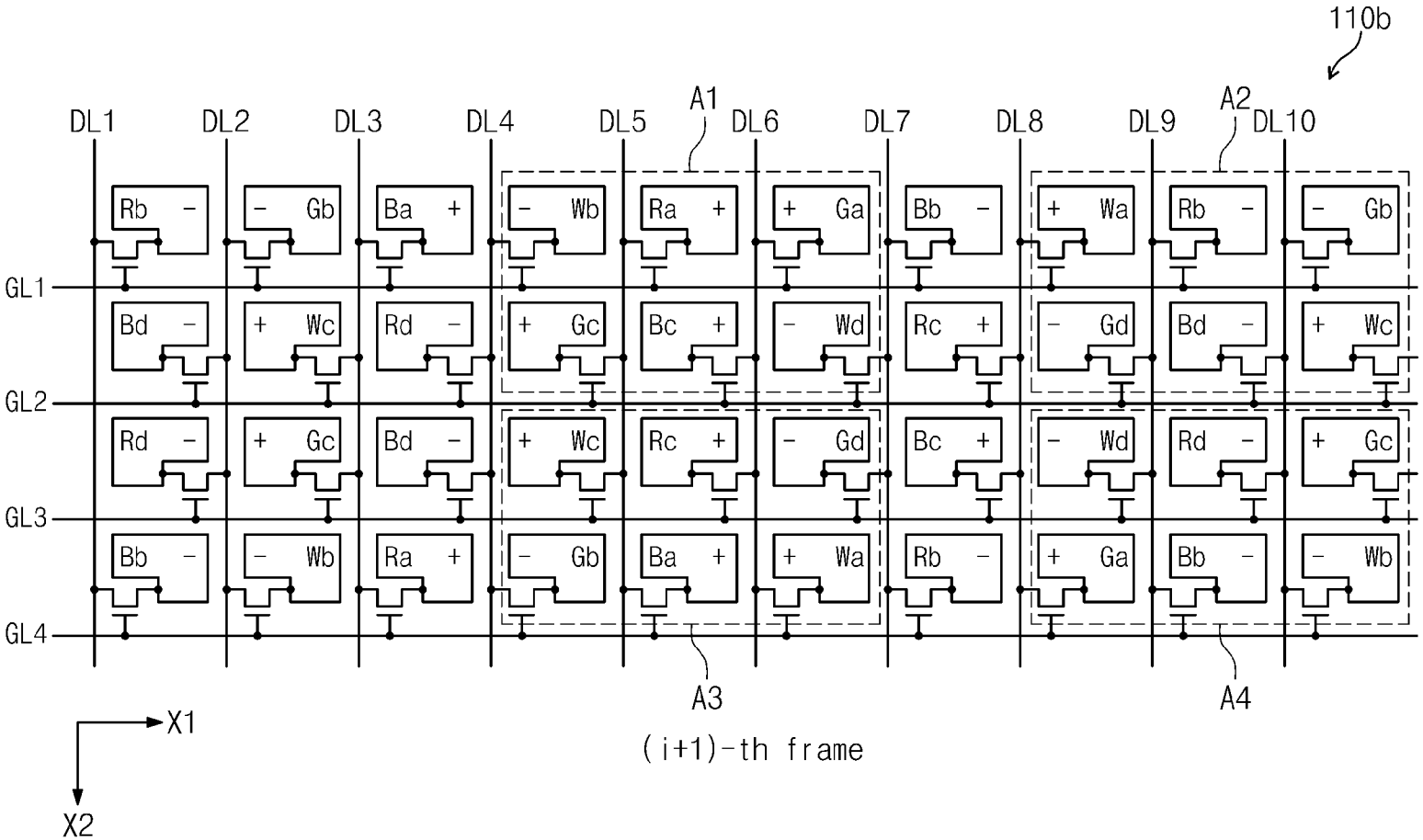

FIG. 5 shows pixels in the display panel 110*b* in the i-th frame, and FIG. 6 shows the pixels in the display panel 110*b* in the (i+1)-th frame. In FIG. 5, the green sub-pixel will now be described in detail as a representative example for convenience of description.

Referring to FIG. 5, the green sub-pixels of first and fourth areas A1 and A4 of the display panel 110*b* are driven by the negative (−) gray-scale voltage during the i-th frame, and the green sub-pixels of second and third areas A2 and A3 of the di splay panel 110*b* are driven by the positive (+) gray-scale voltage during the i-th frame. When the parasitic capacitance Cgd of the switching transistor in each green su b-pixels of the first and fourth areas A1 and A4 is greater than the parasitic capacitance Cgd of the switching transistor in each green sub-pixels of the second and third areas A2 and A3, the voltage level of the negative (−) gray-scale voltage Vsig becomes lower by the kick back voltage ΔVNEG as shown in FIG. 4 such that brightness of the green sub-pixels of the first and fourth areas A1 and A4 is greater than bright ness of the green sub-pixels of the second and third areas A2 and A3 in the i-th frame.

Referring to FIG. 6, the green sub-pixels of the first and fourth areas A1 and A4 of the display panel 110*b* are driven by the positive (+) gray-scale voltage during the i-th frame, and the green sub-pixels of second and third areas A2 and A3 of the display panel 110*b* are driven by the negative (−) gray-scale voltage during the (i+1)-th frame.

When the parasitic capacitance Cgd of the switching transistor in each green sub-pixels of the first and fourth areas A1 and A4 is greater than the parasitic capacitance Cgd of the switching transistor in each green sub-pixels of the second and third areas A2 and A3, the brightness of the green sub-pixels of the second and third are as A2 and A3 is greater than brightness of the green sub-pixels of the first and fourth areas A1 and A4 in the (i+1)-th frame.

Referring to FIGS. 5 and 6, the brightness of the green sub-pixels of the first and fourth areas A1 and A4 is greater than brightness of the green sub-pixels of the second and third areas A2 and A3 in the i-th frame, and the brightness of the green sub-pixels of the second and third areas A2 and A3 is greater than brightness of the green sub-pixels of the first and fourth areas A1 and A4 in the (i+1)-th frame. Therefore, the flicker, in which the brightness of the first to fourth areas A1 to A4 is varied every frame, may be perceived.

Figure 7:
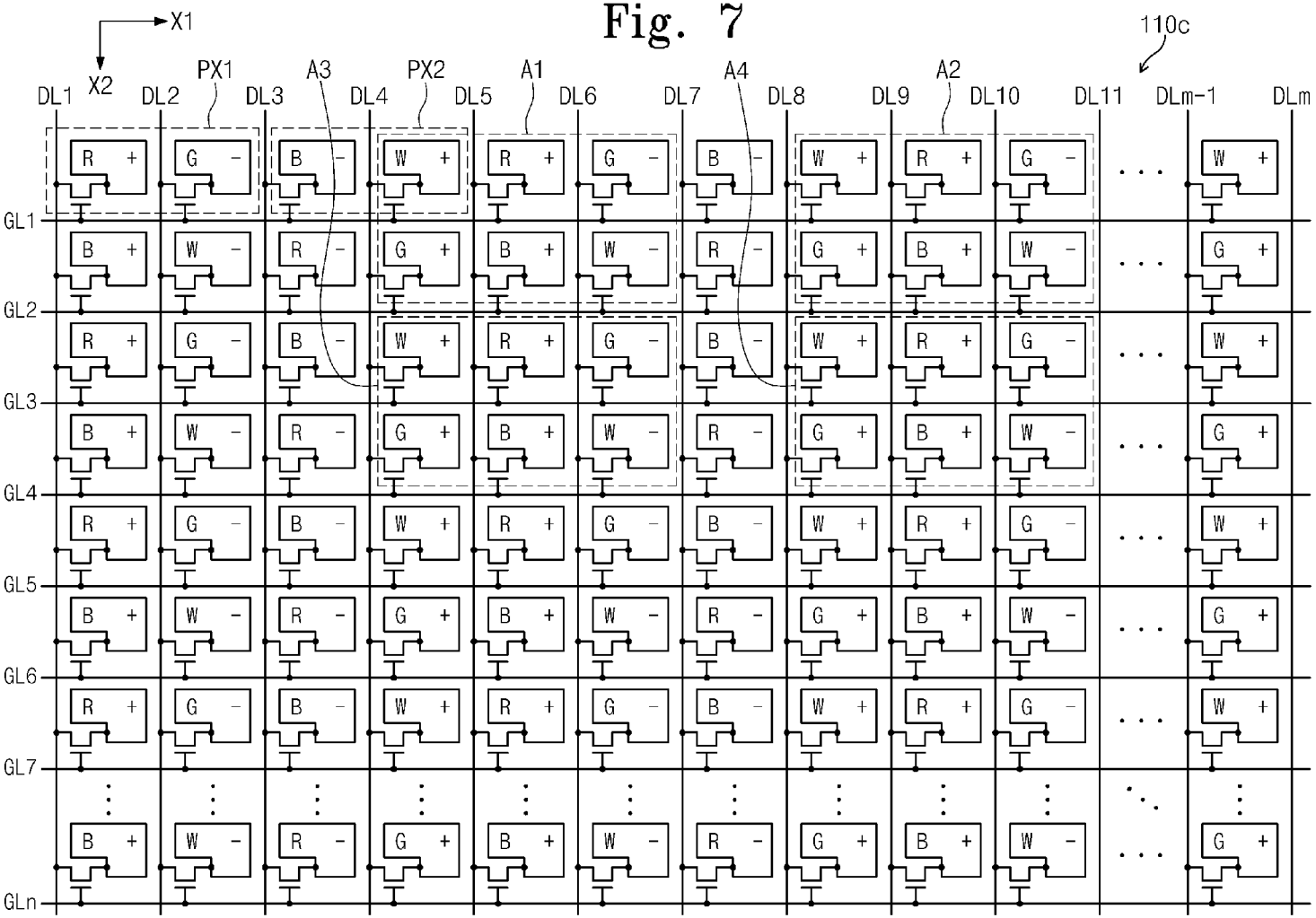
FIG. 7 is a view showing another alternative exemplary embodiment of an arrangement of pixels in a display panel shown in FIG. 1 according to the invention.

FIG. 7 is a view showing another alternative exemplary embodiment of an arrangement of pixels in the display panel shown in FIG. 1 according to the invention. Referring to FIG. 7, a display panel 110*c* includes a plurality of unit pixels in eluding a first type pixel PX1 and a second type pixel PX2 as in the exemplary embodiments shown in FIGS. 2 and 3. Each of first and second type pixels PX1 and PX2 includes an even number of sub-pixels. In an exemplary embodiment, as shown in FIG. 7, each of first and second type pixels PX1 and PX2 includes two sub-pixels.

In one exemplary embodiment, for example, the first type pixel PX1 includes a read sub-pixel R and a green sub-pixel G, and the second type sub-pixel PX2 includes a blue sub-pixel B and a white sub-pixel W. In such an embodiment, the arrangement of the red, green, blue and white sub-pixels R, G, B and W of the display panel 110*c* is substantially the same as the arrangement of the red, green, blue and white sub-pixels R, G, B and W of the display panel 110*a* shown in FIG. 2.

However, the connection structure between the red, green, blue and white sub-pixels R, G, B and W and the data lines DL1 to DLm of the display panel 110*c* is different from the connection structure between the red, green, blue and white sub-pixels R, G, B and W and the data lines DL1 to DLm of the display panel 110*a* shown in FIG. 2.

In an exemplary embodiment, as shown in FIG. 7, the red, green, blue and white sub-pixels R, G, B and W are connected to the left-side data line thereof. The data driver 140 shown in FIG. 1 inverts the polarity of the gray-scale voltage every two data lines, and two adjacent sub-pixels in a same unit pixel are applied with the gray-scale voltages having different polarities.

In one exemplary embodiment, for example, when the red and blue pixels R and B connected to the first data line DL1 are driven by the positive (+) gray-scale voltage, the green, white, blue and red pixels G, W, B and R connected to (4d−2)-th and (4d−1)-th data lines DL4d−3 and DL4d−2 (d is a positive integer) are driven by the negative (−) gray-scale voltage. The white, green, red, and blue pixels W, G, R and BR connected to 4d-th and (4d+1)-th data lines DL4d and DL4d+1 are driven by the positive (+) gray-scale voltage. In such an embodiment, the sub-pixels arranged in the first direction X1, in which the gate lines GL1 to GLn extend, are driven in the order of positive (+), negative (−), negative (−), positive (+), positive (+), negative (−) and negative (−) gray-scale voltages.

The green sub-pixel driven by the positive (+) gray-scale voltage and the green sub-pixel driven by the negative (−) gray-scale voltage are arranged in each of the first, second, third and fourth areas A1, A2, A3 and A4, such that the brightness difference is effectively prevented from being perceived in the i-th frame and the (i+1)-th frame.

Figure 8:
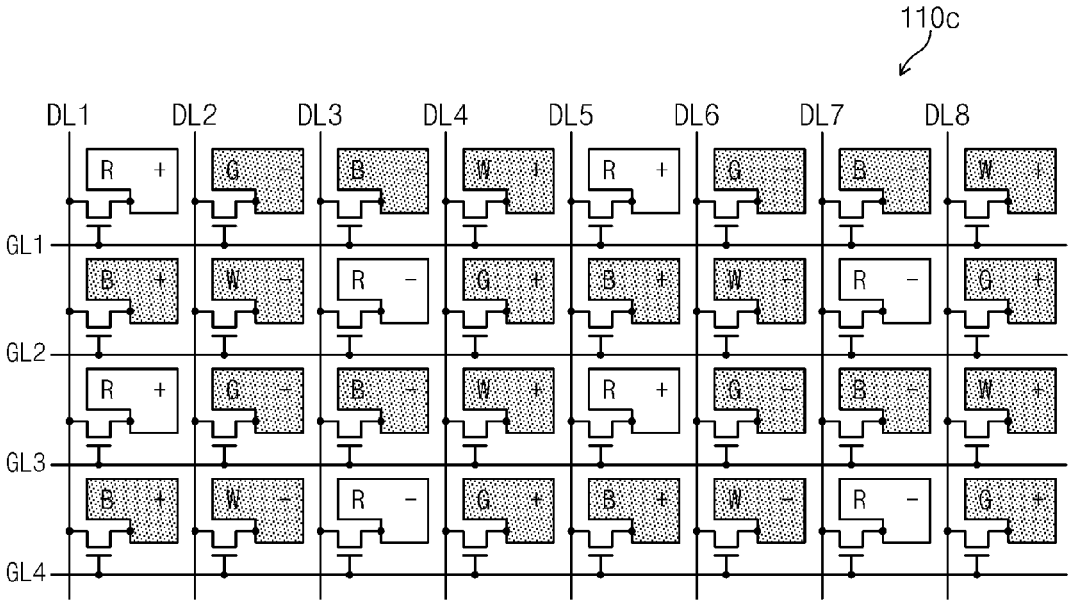
FIG. 8 is a view showing a portion of the display panel shown in FIG. 7.

FIG. 8 is a view showing a portion of the display panel shown in FIG. 7.

Referring to FIG. 8, in an exemplary embodiment, when a red color is displayed on the display panel 110*c*, the green, blue and white sub-pixels may be applied with a lowest gray-scale voltage, and the red sub-pixel may be applied with a highest gray-scale voltage.

Figure 9:
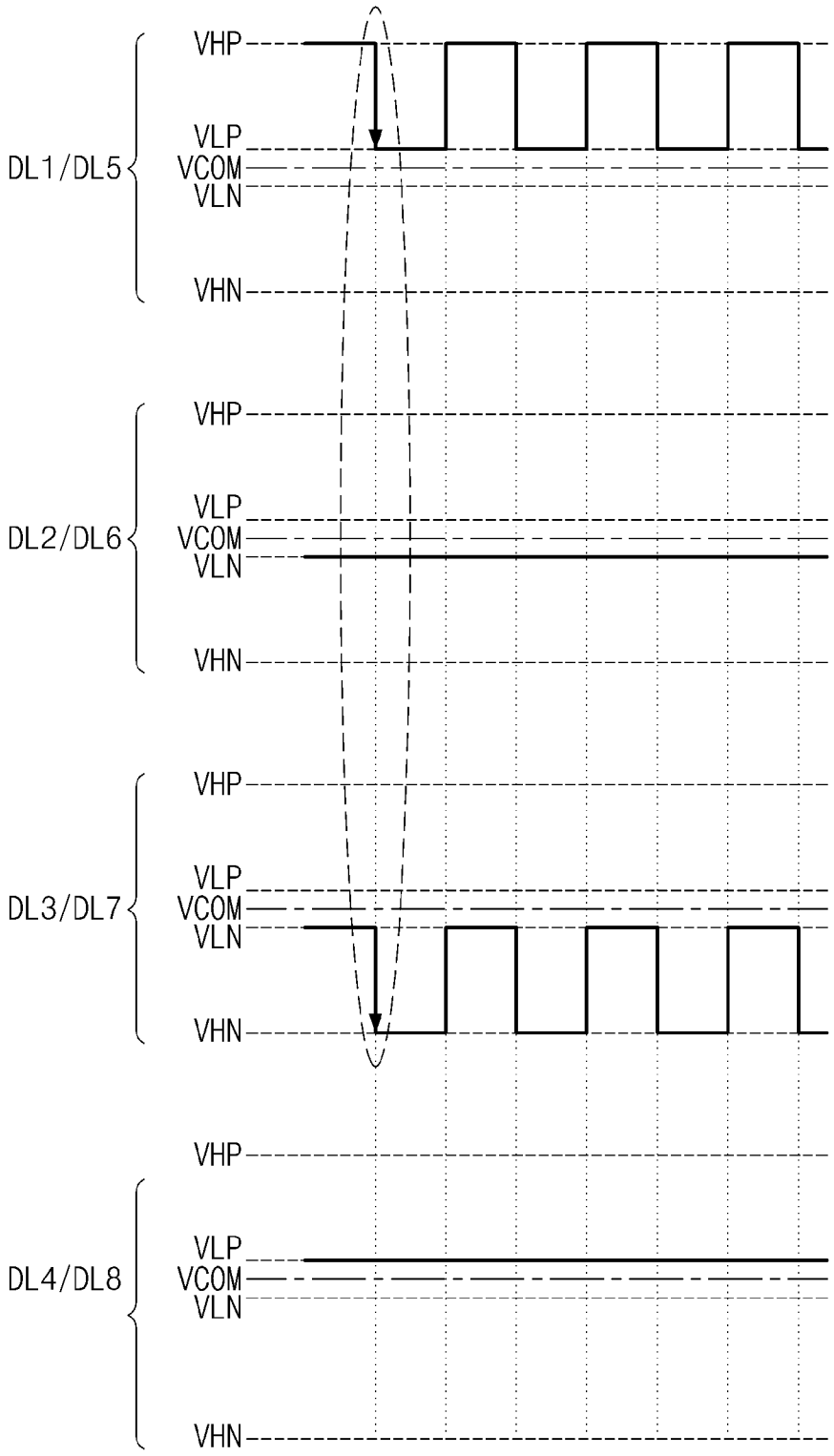
FIG. 9 is a waveform diagram showing an exemplary embodiment of gray-scale voltages applied to data lines of the display panel shown in FIG. 8.

FIG. 9 is a waveform diagram showing gray-scale voltages applied to the data lines of the display panel shown in FIG. 8.

Referring to FIGS. 8 and 9, in an exemplary embodiment, the data lines DL1 to DLm may be driven in the i-th frame as follows. The data lines connected to the red and blue sub-pixels R and B, e.g., first and fifth data lines DL1 and DL5, are alternately driven with the highest gray-scale voltage VHP and the lowest gray-scale voltage VLP every horizontal line, and the data lines connected to the green and white sub-pixels G and W, e.g., second and sixth data lines DL2 and DL6, are driven with the lowest gray-scale voltage VLN. The data lines connected to the red and blue sub-pixels R and B, e.g., third and seventh data lines DL3 and DL7, are alternately driven with the lowest gray-scale voltage VLN and the highest gray-scale voltage VHN every horizontal line, and the data lines connected to the green and white sub-pixels G and W, e.g., fourth and eighth data lines DL4 and DL8, are driven with the lowest gray-scale voltage VLP.

When the gray-scale voltages applied to the data lines, e.g., the first, third, fifth and the seventh data lines DL1, DL3, DL5 and DL7, are simultaneously changed the lowest gray-scale voltage VLP from the highest gray-scale voltage VHP or to the highest gray-scale voltage VHN from the lowest gray-scale voltage VLN, the common voltage VCOM adjacent to the data lines DL1, DL3, DL5 and DL7 may be distorted by a coupling capacitance.

FIG. 8 shows the display panel 100*c* displaying only the red color, for convenience of description. Similarly, a ripple may occur in the common voltage VCOM when the green or blue color is displayed in the display panel 110*c*.

Figure 10:
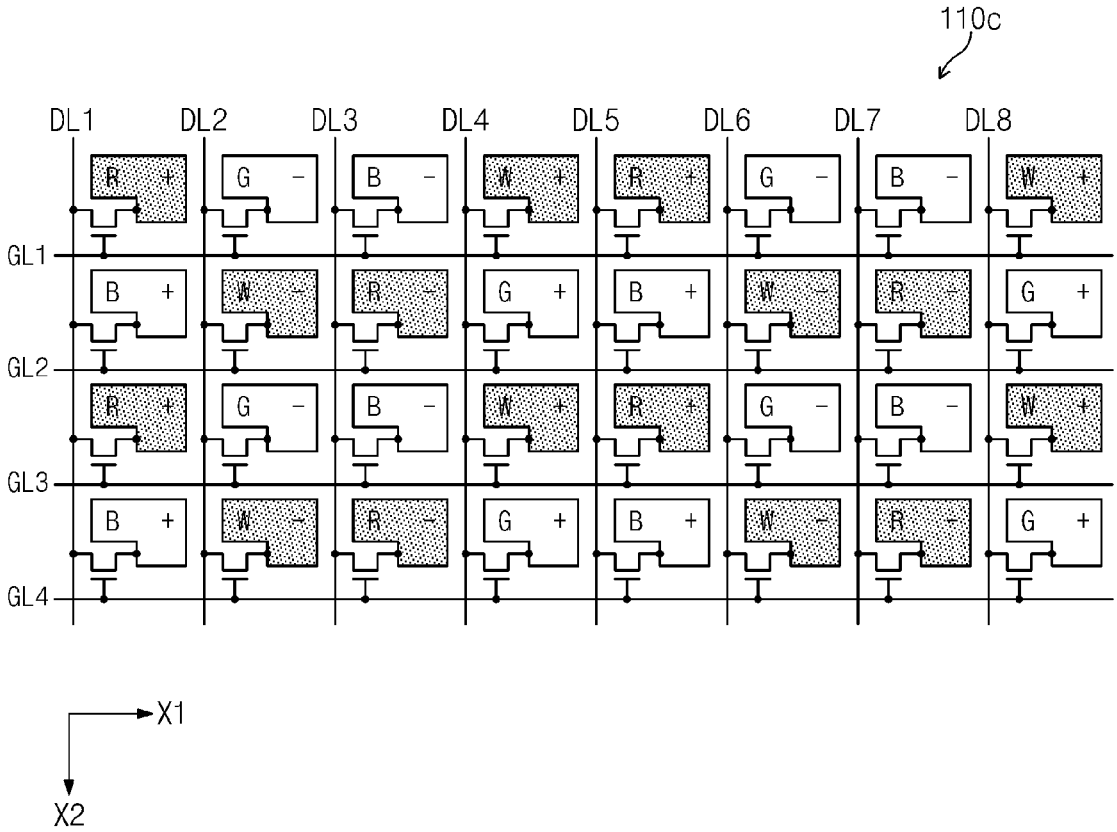
FIG. 10 is a view showing a portion of the display panel shown in FIG. 7.

FIG. 10 is a view showing a portion of the display panel shown in FIG. 7.

Referring to FIG. 10, in an exemplary embodiment, when a cyan color is displayed on the display panel 110*c*, the green and blue sub-pixels may be applied with the highest gray-scale voltage and the red and white sub-pixels may be applied with the lowest gray-scale voltage.

Figure 11:
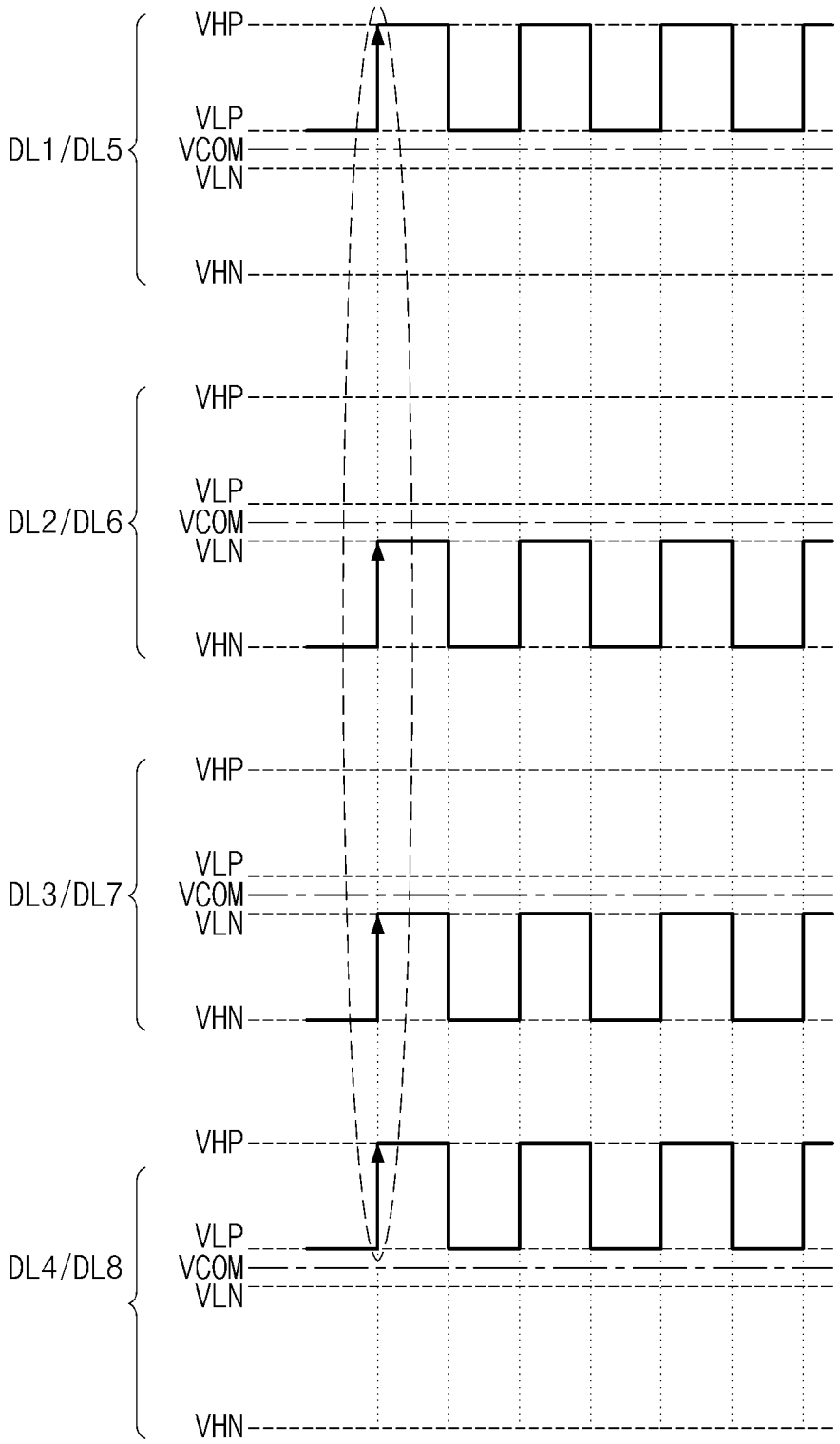
FIG. 11 is a waveform diagram showing an exemplary embodiment of gray-scale voltages applied to data lines of the display panel shown in FIG. 10.

FIG. 11 is a waveform diagram showing gray-scale voltages applied to data lines of the display panel shown in FIG. 10.

Referring to FIGS. 10 and 11, the data lines DL1 to DLm may be driven in the i-th frame as follows. The data lines connected to the red and blue sub-pixels R and B, e.g., the first and fifth data lines DL1 and DL5, are alternately driven with the lowest gray-scale voltage VLP and the highest gray-scale voltage VHP every horizontal line, and the data lines connected to the green and white sub-pixels G and W, e.g., the second and sixth data lines DL2 and DL6, are alternately driven with the highest gray-scale voltage VHN and the lowest gray-scale voltage VLN every horizontal line. The data lines connected to the red and blue sub-pixels R and B, e.g., the third and seventh data lines DL3 and DL7, are alternately driven with the highest gray-scale voltage VHN and the lowest gray-scale voltage VLN every horizontal line, and the data lines connected to the green and white sub-pixels G and W, e.g., the fourth and eighth data lines DL4 and DL8, are alternately driven with the lowest gray-scale voltage VLP and the highest gray-scale voltage VHP every horizontal line.

When the gray-scale voltages applied to the data lines, e.g., the first to seventh data lines DL1 to DL7, are simultaneously changed to the lowest gray-scale voltage VLP from the highest gray-scale voltage VHP or to the highest gray-scale voltage VHN from the lowest gray-scale voltage VLN, the common voltage VCOM adjacent to the data lines DL1 to DL7 may be distorted by a coupling capacitance, and the distortion of the common voltage may cause a horizontal crosstalk phenomenon.

Figure 12:
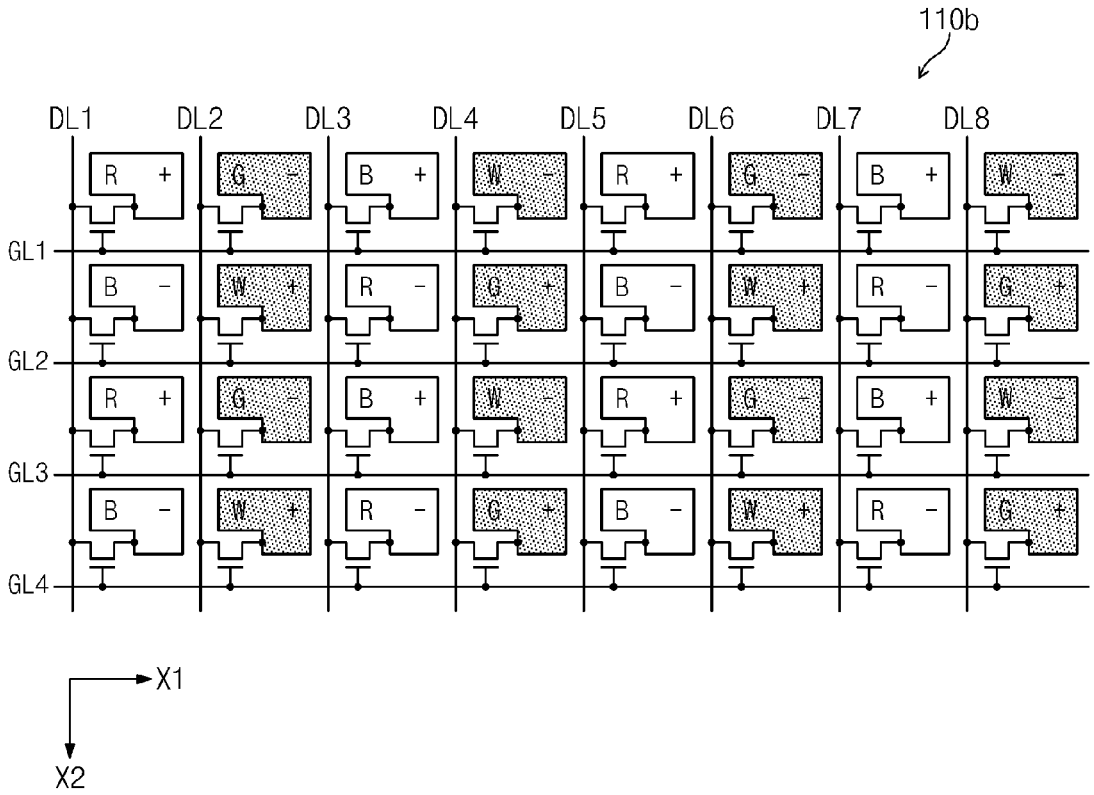
FIG. 12 is a view showing a portion of the display panel shown in FIG. 3.

FIG. 12 is a view showing a portion of the display panel shown in FIG. 3.

Referring to FIG. 12, in an exemplary embodiment, when a cyan color is displayed on the display panel 110*b*, the green and blue sub-pixels may be applied with the highest gray-scale voltage and the red and white sub-pixels may be applied with the lowest gray-scale voltage.

Figure 13:
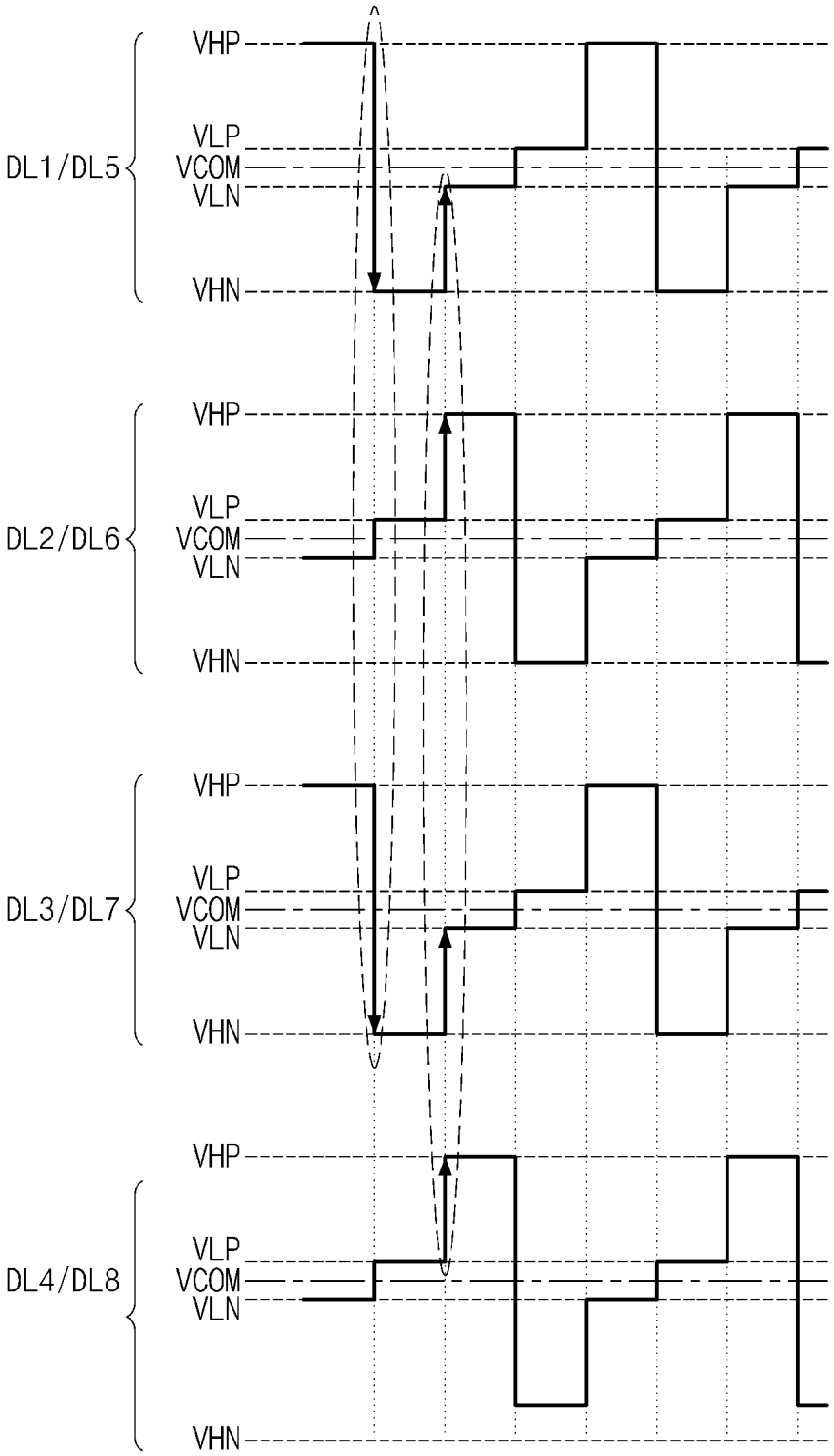
FIG. 13 is a waveform diagram showing an exemplary embodiment of gray-scale voltages applied to data lines of the display panel shown in FIG. 12.

FIG. 13 is a waveform diagram showing gray-scale voltages applied to data lines of the display panel shown in FIG. 12.

Referring to FIGS. 12 and 13, the data lines DL1 to DLm may be driven in the i-th frame as follows. When the data lines connected to the red and blue sub-pixels R and B, e.g., the first and fifth data lines DL1 and DL5, are changed to and driven with the highest gray-scale voltage VHN from the highest gray-scale voltage VHP, the data lines connected to the red and blue sub-pixels R and B, e.g., the third and seventh data lines DL3 and DL7, are changed to and driven with the highest gray-scale voltage VHN from the highest gray-scale voltage VHP.

When the data lines connected to the red and blue sub-pixels R and B, e.g., the first and fifth data lines DL1 and DL5, are changed to and driven with the lowest gray-scale voltage VLN from the highest gray-scale voltage VHN, the data lines connected to the green and white sub-pixels G and W, e.g., the second and sixth data lines DL2 and DL6, are changed to and driven with the highest gray-scale voltage VHP from the lowest gray-scale voltage VLP, the data lines connected to the red and blue sub-pixels R and B, e.g., the third and seventh data lines DL3 and DL7, are changed to and driven with the lowest gray-scale voltage VLP from the highest gray-scale voltage VHN, and the data lines connected to the green and white sub-pixels G and W, e.g., the fourth and eighth data lies DL4 and DL8, are changed to and driven with the highest gray-scale voltage VHP from the lowest gray-scale voltage VLP. In such an embodiment, when the data lines are substantially simultaneously increased to the high voltage level from the low voltage level, the voltage level of the common voltage VCOM is increased, such that a crosstalk may occur on the image displayed on the display panel 110*b*.

Figure 14:
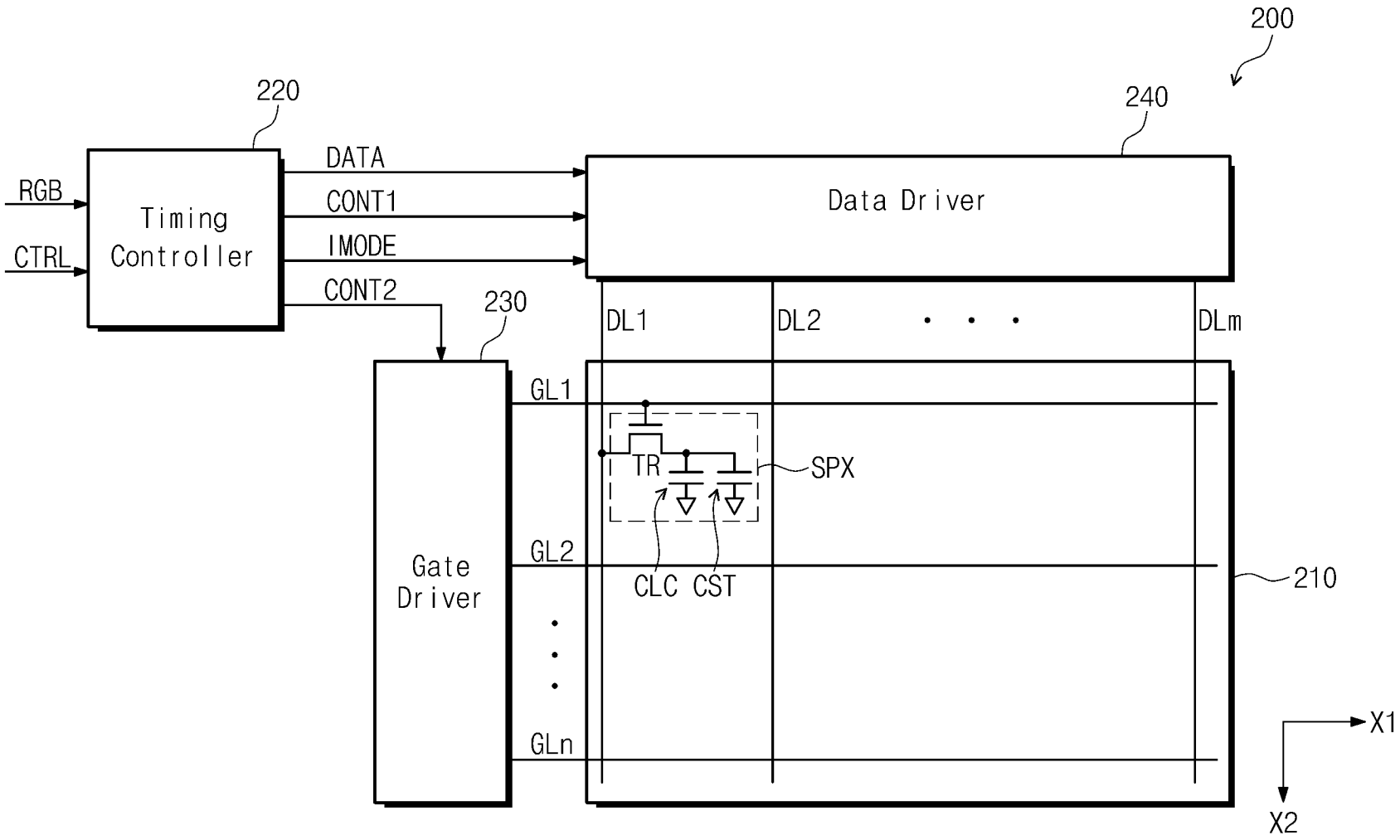
FIG. 14 is a block diagram showing an alternative exemplary embodiment of a display device according to the invention.

FIG. 14 is a block diagram showing an alternative exemplary embodiment of a display device according to the invention.

Referring to FIG. 14, a display device 200 includes a display panel 210, a timing controller 220, a gate driver 230 and a data driver 240.

The display panel 210 and the gate driver 230 of the display device 200 shown in FIG. 14 is substantially the same as the display panel 110 and the gate driver 130 of the display device 100 in FIG. 1, and any repetitive detailed descriptions of the display panel 210 and the gate driver 230 of the display device 200 in FIG. 14 will hereinafter be omitted.

The timing controller 220 receives image signals RGB and control signals CTRL, e.g., a vertical synchronization signal, a horizontal synchronization signal, a main clock signal, a data enable signal, etc., to control the image signals RGB. The timing controller 220 converts the image signal RGB to data signal DATA corresponding to an operation condition of the display panel 210 based on the control signals CTRL. The timing controller 220 applies the data signal DATA, a first control signal CONT1 and an inversion mode signal IMODE to the data driver 240, and applies a second control signal CONT2 to the gate driver 230. The first control signal CONT1 may include a horizontal synchronization start signal, a clock signal, and a line latch signal, and the second control signal CONT2 includes a vertical synchronization start signal, an output enable signal and a gate pulse signal, for example.

The data driver 240 outputs gray-scale voltages to drive the data lines DL1 to DLm in response to the data signal DATA, the first control signal CONT1 and the inversion mode signal IMODE from the timing controller 220. In an exemplary embodiment, the data driver 240 determines the polarities of the gray-scale voltages in response to the inversion mode signal IMODE.

Figure 15:
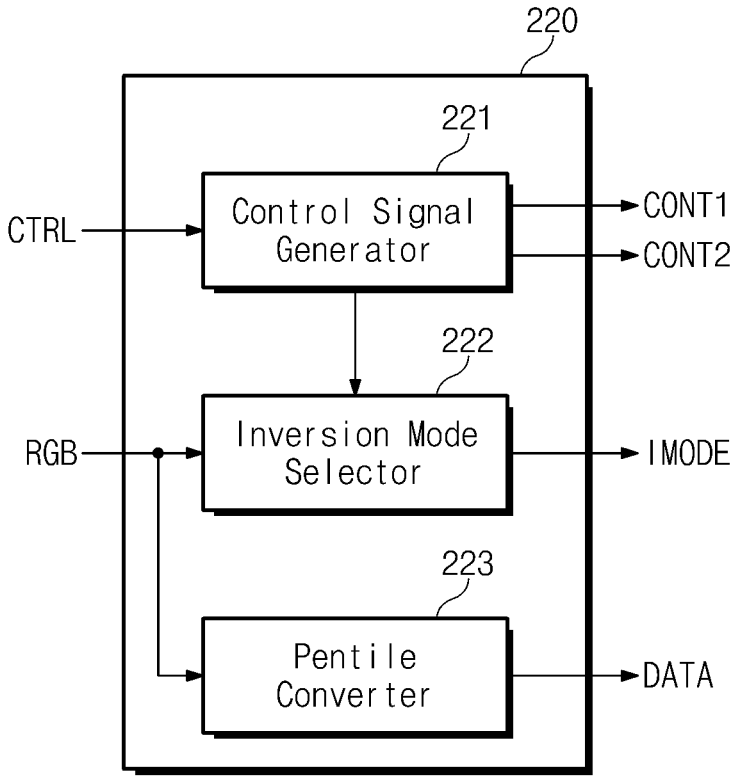
FIG. 15 is a block diagram showing an exemplary embodiment of a timing controller shown in FIG. 14.

FIG. 15 is a block diagram showing an exemplary embodiment of a timing controller shown in FIG. 14.

Referring to FIG. 15, the timing controller 220 includes a control signal generator 221, an inversion mode selector 222 and a pentile converter 223. The control signal generator 221 receives the control signals CTRL from an external source (not shown) and outputs the first control signal CONT1 and the second control signal CONT2. The second control signal CONT2 includes the vertical synchronization start signal STV (shown in FIG. 17).

The inversion mode selector 222 receives the image signals RGB and activates the inversion mode signal IMODE, e.g., changes the level of the inversion mode signal IMODE from a first level (e.g., a low level) to a second level (e.g., a high level), when the image signals RGB have a predetermined image pattern. In one exemplary embodiment, for example, when the image signals RGB have the image pattern shown in FIG. 8, 10 or 12, the crosstalk occurs on the image displayed in the display panel 210. In an exemplary embodiment, when the image signals RGB has the predetermined image pattern, e.g., the image pattern shown in shown in FIG. 8, 10 or 12, the inversion mode signal IMODE is activated from the first level to the second level.

In an exemplary embodiment, the inversion mode selector 222 further includes a memory, e.g., a non-volatile memory, to store information about the predetermined image pattern in which the crosstalk may occur.

The pentile converter 223 receives the image signals RGB having the red, green and blue colors and outputs the data signal DATA having the red, green, blue and white colors. The data signal DATA is applied to the data driver 230 shown in FIG. 12.

Figure 16:
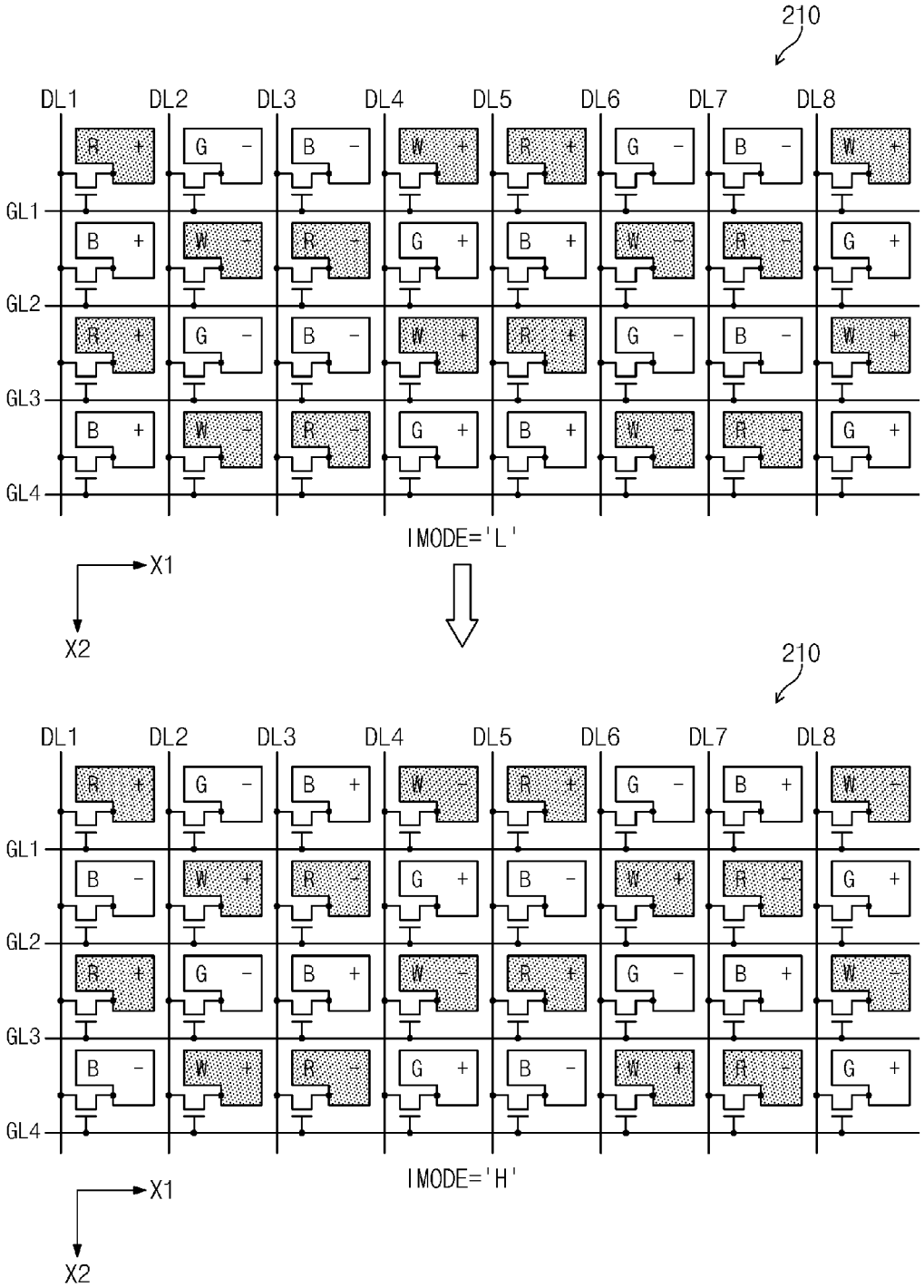
FIG. 16 is a view showing a variation of an exemplary embodiment of a gray-scale voltage used to drive the display panel when an inversion signal output from the timing controller is changed to a high level from a low level.

FIG. 16 is a view showing a variation of the gray-scale voltage used to drive the display panel when the inversion mode signal output from the timing controller is changed to the high level from the low level.

Referring to FIG. 16, in an exemplary embodiment, the data driver 240 drives the data lines DL1 to DLm in a first mode while the inversion mode signal IMODE output from the timing controller 220 shown in FIG. 14 is in the first level, e.g., the low level. In such an embodiment, when the inversion mode signal IMODE is in the first level, similar to the display panel 110*c* shown in FIG. 7, during the i-th frame, the sub-pixels arranged in the first direction X1, in which the gate lines GL1 to GLn extended, are driven with the gray-scale voltages having the polarities inverted every two columns except for the first column, e.g., in the order of positive (+), negative (−), negative (−), positive (+), positive (+), negative (−), and negative (−) gray-scale voltages. Although not shown in figures, during the (i+1)-th frame, the sub-pixels arranged in the first direction X1, in which the gate lines GL1 to GLn are extended, are driven with the gray-scale voltages having the polarities inverted every two columns except for the first column, e.g., in the order of negative (−), positive (+), positive (+), negative (−), negative (−), positive (+) and positive (+) gray-scale voltages.

When the image signals RGB have the predetermined pattern that may cause the crosstalk, the inversion mode signal IMODE is activated from the first level, e.g., the low level, to the second level, e.g., the high level. When the inversion mode signal IMODE is activated to the second level, the data driver 240 drives the data line DL1 to DLm in a second mode (e.g., a dot inversion mode) such that the data driver 240 changes the polarities of the gray-scale voltages in a dot inversion mode. In such an embodiment, when the data lines DL1 to DLm are driven in the second mode, during the i-th frame, the sub-pixels connected to odd-numbered gate lines GL1, GL3, . . . , GLn-1 and arranged in the first direction X1 are driven with the gray-scale voltages having the polarities inverted every column, e.g., in the order of positive (+), negative (−), positive (+), and negative (−) gray-scale voltages, and the sub-pixels connected to even-numbered gate lines GL2, GL4, . . . , GLn and arranged in the first direction X1 are driven with the gray-scale voltages having the polarities opposite to polarities of the gray-scale voltages applied to the sub-pixels connected to the odd-numbered gate lines GL1, GL3, . . . , GLn-1 and inverted every column, e.g., in the order of negative (−), positive (+), negative (−), and positive (+) gray-scale voltages.

Although not shown in figures, during the (i+1)-th frame, the sub-pixels connected to the odd-numbered gate lines GL1, GL3, . . . , GLn-1 and arranged in the first direction X1 are driven with the gray-scale voltages having the polarities inverted every column, e.g., in the order of negative (−), positive (+), negative (−) and positive (+) gray-scale voltages, and the sub-pixels connected to the even-numbered gate lines GL2, GL4, . . . , GLn and arranged in the first direction X1 are driven with the gray-scale voltages having the polarities opposite to those of the gray-scale voltages applied to the sub-pixels connected to the odd-numbered gate lines GL1, GL3, . . . , GLn-1 and inverted every column, e.g., in the order of positive (+), negative (−), positive (+) and negative (−) gray-scale voltages.

In such an embodiment, when the data driver 240 operates in the second mod e, e.g., the dot inversion mode, among the green sub-pixels G and the blue sub-pixels B shown in FIG. 16, the number of the sub-pixels driven with the positive (+) gray-scale voltage is equal to the number of the sub-pixels driven with the negative (−) gray-scale voltage, and the crosstalk is thereby effectively prevented.

In such an embodiment, when only the sub-pixels corresponding to the color of one of the red, green and blue sub-pixels R, G, and B are driven with the highest gray-scale voltage, the data driver 240 operates in the second mode, e.g., the dot in version mode such that the number of the sub-pixels driven with the positive (+) gray-scale voltage is equal to the number of the sub-pixels driven with the negative (−) gray-scale voltage, and the crosstalk is thereby effectively prevented.

Figure 17:
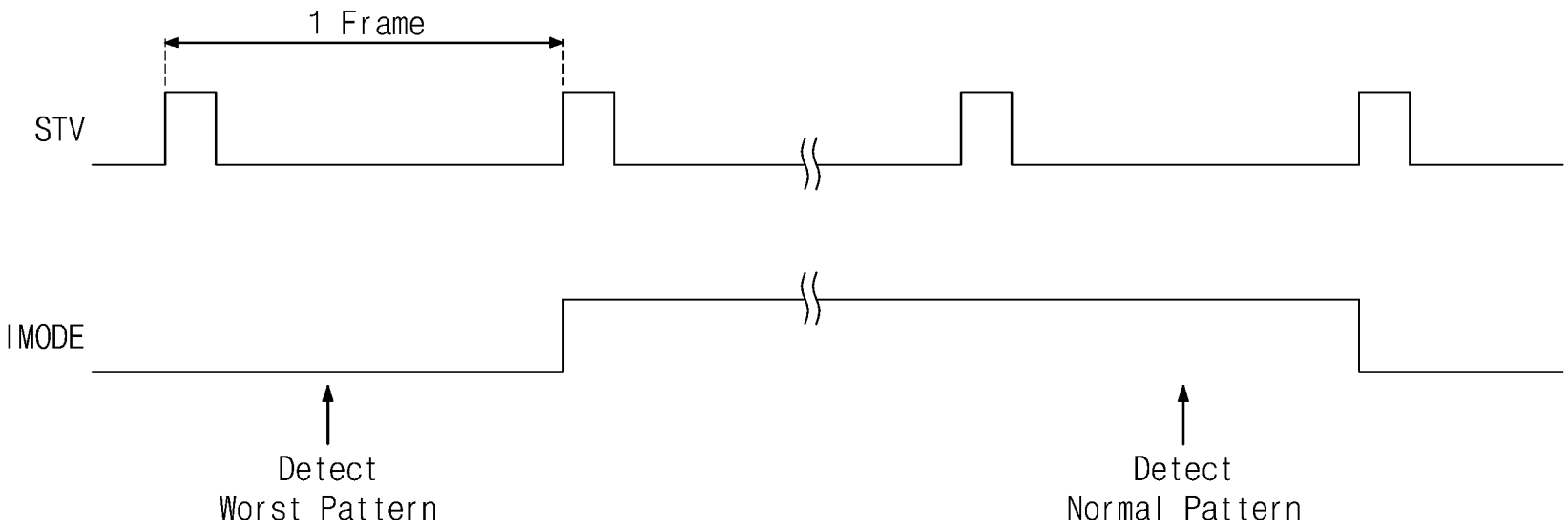
FIG. 17 is a waveform diagram showing an exemplary embodiment of the inverting signal output from an inversion mode selector shown in FIG. 15.

FIG. 17 is a waveform diagram showing an exemplary embodiment of the inverting signal output from the inversion mode selector shown in FIG. 15.

Referring to FIGS. 15 and 17, in an exemplary embodiment, the inversion mode selector 222 receives the image signals RGB from the external source (not shown) and outputs the inversion mode signal IMODE in synchronization with the vertical synchronization start signal STV. In such an embodiment, when the predetermined pattern is detected while the image signals RGB corresponding to one frame are input, the inversion mode selector 222 activates the inversion mode signal IMODE at a starting point of a next frame. In such an embodiment, when the predetermined pattern is not detected while the image signals RGB corresponding to one frame are input, the inversion mode selector 222 inactivates the inversion mode signal IMODE at the starting time point of the next frame.

Although the exemplary embodiments of the invention have been described, it is understood that the invention should not be limited to these exemplary embodiment but various changes and modifications can be made by one ordinary skilled in the art within the spirit and scope of the invention as hereinafter claimed.

What is claimed is:

1. A display device comprising:

a display panel comprising:

a plurality of gate lines which extends in a first direction;

a plurality of data lines which extends in a second direction different from the first direction; and a plurality of sub-pixels, wherein each of the sub-pixels is connected to a corresponding gate line of the gate lines and a corresponding data line of the data lines;

a gate driver configured to drive the gate lines;

a data driver configured to apply a gray-scale voltage to the data lines; and a timing controller configured to generate a plurality of control signals and to apply the control signals to the gate driver and the data driver, wherein a unit pixel of the display panel comprises a first type pixel and a second type pixel, the first type pixel is defined by only first and second sub-pixels among the sub-pixels, the first and second sub-pixels display different colors and each first type pixel has a same order of the first and second sub-pixels arranged in the first direction, the second type pixel is defined by only third and fourth sub-pixels among the sub-pixels, the third and fourth sub-pixels display different colors and each second type pixel has a same order of the third and fourth sub-pixels arranged in the first direction, and one of the first and second type pixels is adjacent only to the other type pixels of the first and second type pixels in the first and second directions respectively, each of the data lines is connected to corresponding sub-pixels of the sub-pixels, the first and second sub-pixels are applied with gray-scale voltages having different polarities and the third and fourth sub-pixels are applied with gray-scale voltages having different polarities, and for all the sub-pixels, adjacent sub-pixels of different type pixels in the first or second directions are applied with gray-scale voltages having a same polarity.

2. The display device of claim 1, wherein the sub-pixels comprises a red sub-pixel, a green sub-pixel, a blue sub-pixel and a white sub-pixel, and each of the first and second type pixels comprises only two sub-pixels among the red sub-pixel, the green sub-pixel, the blue sub-pixel and the white sub-pixel of the even number of adjacent sub-pixels.

3. The display device of claim 2, wherein the first type pixel comprises the red sub-pixel and the green sub-pixel, and the second type pixel comprises the blue sub-pixel and the white sub-pixel.

4. The display device of claim 2, wherein, a first data line of the data lines is connected to red and blue sub-pixels of the subpixels, which are alternately arranged with each other in the second direction, a second data line of the data lines is connected to green and white sub-pixels of the subpixels, which are alternately arranged with each other in the second direction, a third data line of the data lines is connected to blue and red sub-pixels of the subpixels, which are alternately arranged with each other in the second direction, a fourth data line of the data lines is connected to white and green sub-pixels of the subpixels, which are alternately arranged with each other in the second direction, and the first, second, third and fourth data lines are sequentially arranged in the first direction.

5. The display device of claim 2, wherein the timing controller applies a data signal to the data driver in response to an image signal from an outside thereof and activates an inversion mode signal when the image signal has a predetermined image pattern.

6. The display device of claim 5, wherein the data driver receives the data signal and the inversion mode signal, and the data driver sets the polarity of the gray-scale voltage applied to the data lines in response to the inversion mode signal.

7. The display device of claim 6, wherein the data driver inverts the polarity of the gray-scale voltage every two data lines when the inversion mode signal is inactivated, and the data driver sets the polarities of the gray-scale voltages applied to the two adjacent sub-pixels in the unit pixel to be different from each other.

8. The display device of claim 6, wherein the data driver inverts the polarity of the gray-scale voltage every data line when the inversion mode signal is activated.

9. The display device of claim 6, wherein the data driver inverts the polarity of the gray-scale voltage applied to the each of the data lines every frame.

10. The display device of claim 5, wherein the timing controller comprises:

a pentile converter configured to convert the image signal to the data signal corresponding to the red, green, blue and white sub-pixels; and an inversion mode selector configured to activate the inversion mode signal when the image signal has the predetermined image pattern.

11. The display device of claim 10, wherein the predetermined image pattern comprises an image pattern displayed by turning on the green and blue sub-pixels and turning off the red and white sub-pixels.

12. The display device of claim 5, wherein when the image signal has the predetermined image pattern in a frame, the timing controller activates the inversion mode signal at a starting point of a next frame.

13. The display device of claim 1, wherein the each of the data lines is connected to a left side of the corresponding sub-pixels of the sub-pixels.

14. The display device of claim 1, wherein the data driver inverts the polarity of the gray-scale voltage applied to the each of the data lines every frame.

* * * * *